US005330411A

United States Patent [19]

Fujitani et al.

[11] Patent Number: 5,330,411

[45] Date of Patent: Jul. 19, 1994

[54] LEVER-TYPE CONNECTOR

[75] Inventors: Mitsuhiro Fujitani; Toshikazu Saba, both of Yokkaichi; Tatsuo Fukuyama, Hiroshima, all of Japan

[73] Assignee: Sumitomo Wiring Systems, Ltd., Mie, Japan

[21] Appl. No.: 963,741

[22] Filed: Oct. 20, 1992

[30] Foreign Application Priority Data

Oct. 21, 1991 [JP] Japan ..... 3-85656[U]
Oct. 21, 1991 [JP] Japan ..... 3-85657[U]
Oct. 21, 1991 [JP] Japan ..... 3-85658[U]

[51] Int. Cl.[5] ..... H01R 13/62
[52] U.S. Cl. ..... 439/157; 439/372
[58] Field of Search ..... 439/372, 152–160

[56] References Cited

U.S. PATENT DOCUMENTS 2,939,103 5/1960 Agron et al. ..... 439/157
2,987,693 6/1991 Wamsley ..... 439/157
3,603,910 9/1971 Schumacher ..... 439/160
5,135,410 8/1992 Kawase et al. ..... 439/372
5,174,785 12/1992 Endo et al. ..... 439/372

FOREIGN PATENT DOCUMENTS 0389677 3/1990 European Pat. Off. .
0459448 4/1991 European Pat. Off. .
3862332 8/1989 Fed. Rep. of Germany ..... 439/372
0656875 2/1990 Japan ..... 439/372
2179506A 3/1987 United Kingdom .

*Primary Examiner*—David L. Pirlot
*Attorney, Agent, or Firm*—Sughrue, Mion, Zinn, Macpeak & Seas

[57] ABSTRACT

A lever type connector comprising: a first connector; a second connector which is fitted into the first connector; a lever which is rotatably mounted on the first connector; and a pin which projects from the second connector; the lever being formed with an engageable hole such that the pin is inserted into the engageable hole when the second connector is fitted into the first connector; wherein by rotating the lever in an operational direction of the lever, the second connector is pulled towards the first connector through the pin upon displacement of the engageable hole so as to be fitted into the first connector; wherein the engageable hole is shaped such that the lever is automatically raised in the operational direction of the lever at a position where the pin is inserted into an inlet of the engageable hole.

1 Claim, 13 Drawing Sheets

LEVER-TYPE CONNECTOR

BACKGROUND OF THE INVENTION

The present invention generally relates to a lever type connector and more particularly, to a lever type connector in which first and second connectors brought into telescopic engagement with each other are coupled with each other by using a lever mounted on the first connector, and the lever can be easily operated for its rotation from a temporary stop position where the lever is retained prior to engagement between the first and second connectors.

Conventionally, since a large coupling force is required when first and second connectors of a multipolar connector having 20 terminals or more are brought into telescopic engagement with each other, a lever type connector is provided in which the first and second connectors can be easily coupled with each other by applying a relatively small force by the use of a lever based on the principle of a lever.

As shown in FIG. 1, a known lever type connector includes first and second connectors 1 and 6 brought into telescopic engagement with each other. The first and second connectors 1 and 6 act as a female connector and a male connector, respectively. A lever 2 is rotatably mounted on opposite side faces of the first connector 1 by a pair of rods 3, while a pair of engageable holes 4 are formed on opposite sides of the lever 2, respectively. A pair of pins 5 project from opposite side faces of the second connector 6 so as to be received by the engageable holes 4, respectively when the second connector 6 is fitted into the first connector 1.

Prior to engagement between the first and second connectors 1 and 6, rotation of the lever 2 in the direction of the arrow X is prevented by a stopper 7 projecting from each of the opposite side faces of the first connector 1, and rotation of the lever 2 in the direction of the arrow Y, i.e., in the operational direction of the lever 2, is prevented by a temporary stop member (not shown) based on a detent mechanism through engagement of an inner face of the lever 2 with a corresponding portion of an outer face of the first connector 1 such that the lever 2 is stopped temporarily.

When the second connector 6 is fitted into the first connector 1, the second connector 6 is depressed in the direction of the arrow A into an opening 8 formed in the first connector 1. A slot 9 is formed on each of opposite side walls of the first connector 1, while a recess 10 is formed on each of opposed inner side faces of the lever 2. Thus, the pin 5 is inserted from the slot 9 into the engageable hole 4 through the recess 10. After the pin 5 has been inserted into the engageable hole 4 upon depression of the second connector 6 into the opening 8 of the first connector 1, the lever 2 is rotated in the direction of the arrow Y. As a result, the pin 5 is moved further into the engageable hole 4 through displacement of the lever 2 and thus, the second connector 6 is pulled towards the bottom of the opening 8 such that the first and second connectors 1 and 6 are coupled with each other.

In the known lever type connector of FIG. 1, the engageable hole 4 has an inlet **4*a* opening in the horizontal direction for inserting the pin 5 into the engageable hole 4, a first guide portion 4*b* extending horizontally from the inlet 4*a* and a second guide portion 4*c* curved upwardly from the first guide portion 4*b*. Furthermore, an arcuate portion 4*d* connects the first and second guide portions 4*b* and 4*c***.

Since the engageable hole 4 has the above described shape, the pin 5 forced into the engageable hole 4 is firmly fitted into the arcuate portion **4*d* as shown in FIG. 2. In addition, the lever 2 is stopped temporarily by the stopper as described above. Therefore, the lever 2 cannot be rotated smoothly by cancelling the temporary stop of the lever 2, thereby resulting in poor operational efficiency. Namely, in order to disengage the pin 5 from the arcuate portion 4*d* of the engageable hole 4, it becomes necessary to either rotate the lever 2 while adjusting a rotational angle of the lever 2 or manually adjust position of the pin 5 relative to the engageable hole 4. Furthermore, in order to cancel the temporary stop of the lever 2, a rotational force exceeding a detent force of the stopper should be applied to the lever 2**.

Meanwhile, in multipolar connectors, since frictional resistance between terminals to be connected is large, a large rotational force is required to be applied to the lever 2 in order to couple the first and second connectors 1 and 6. Therefore, a spring is wound around each of the rods 3 of the lever 2 so as to urge the lever 2 in the direction of the arrow Y such that the lever 2 can be rotated with a small force. Even in the case where the lever 2 is not urged in the direction of the arrow Y by the spring, the lever 2 is required to be retained at a temporary stop position prior to fitting of the second connector 6 into the opening 8 of the first connector 1. To this end, the known lever type connector is provided with a temporary stop member for retaining the lever 2 at the temporary stop position prior to coupling of the first and second connectors 1 and 6.

One example of the temporary stop member in a prior art lever type connector is shown in FIG. 3. In FIG. 3, connectors 11 and 14 are coupled with each other by using a lever 13 supported by a rod 19. The prior art temporary stop member includes a stopper 12 and a V-shaped groove **13*a* formed on the lever 13. A distal end 12*a* of the stopper 12 is engaged with the groove 13*a* so as to temporarily stop the lever 13. In FIG. 3, a pin 16 of the connector 14 is engageable with a slot 15 of the connector 11 and a locking pin 18 of the connector 11 is engageable with a slit 17 of the lever 13**.

In order to cancel the temporary stop of the lever 13, the lever 13 itself is required to be operated so as to disengage the distal end **12*a* of the stopper 12 from the groove 13*a*. Namely, not only when the connectors 11 and 14 are held out of engagement with each other but when the connectors 11 and 14 are held in engagement with each other, the lever 13 is held at the temporary stop position unless an operation for cancelling the temporary stop of the lever 13** is performed.

Therefore, when the connectors 11 and 14 are brought into engagement with each other, the lever 13 cannot be operated for its rotation unless temporary stop of the lever 13 has been cancelled initially. In other words, a large rotational force is required to be applied to the lever 13 at an initial stage of operation of the lever 13, thereby resulting in poor operational efficiency of the lever 13.

Furthermore, as shown in FIG. 4, the known lever type connector of FIG. 1 further includes a lever locking member for locking the lever 2 at the time when the first and second connectors 1 and 6 have been coupled with each other. The lever locking member includes a hollow 28 formed on each of the opposite sides of the lever 2 and a boss 29 engageable with the hollow 28 and projecting from each of the opposite side faces of the second connector 6. As shown in FIG. 5, when the first and second connectors 1 and 6 have been coupled with each-other, the boss 29 is engaged with the hollow 28 so as to lock the lever 2.

As shown in FIG. 6, the hollow 28 of the lever 2 is formed by a mere through-hole and an outer peripheral edge 30 of the hollow 28 has a width L. Therefore, when the boss 29 is brought into engagement with the hollow 28, a large force is required for causing the outer peripheral edge 30 of the hollow 28 to ride over the the boss 29. As a result, an operator finds it difficult to have a sure feeling that the lever has been locked.

The boss 29 has an oblique inlet side face 29*a* and a vertical outlet side face 29*b* as shown in FIG. 6. Therefore, the known lever type connector has such a drawback that locking of the lever 2 cannot be cancelled easily.

SUMMARY OF THE INVENTION

Accordingly, an essential object of the present invention is to provide a lever type connector in which by setting the relative position between an engageable hole and a pin depressed into the engageable hole such that rotation of the lever is not made difficult, the temporary stop of the lever is cancelled upon depression of the pin into the engageable hole and the lever is automatically lifted in an operational direction of the lever such that the operational efficiency of the lever is improved.

Another important object of the present invention is to provide a lever type connector including a temporary stop member for setting-the lever in a temporary stop state prior to engagement between first and second connectors, in which temporary stop of the lever by the temporary stop member is automatically cancelled upon engagement between the first and second connectors such that operational efficiency of the lever is raised.

Still another object of the present invention is to provide a lever type connector including a lever locking member for locking the lever, in which the lever can be locked with a small force so as to enhance a sure feeling of an operator that the lever has been locked and the lever can be unlocked easily.

In order to accomplish the first object of the present invention, a lever type connector according to the present invention comprises: a first connector; a second connector which is fitted into the first connector; a lever which is rotatably mounted on the first connector; and a pin which projects from the second connector; the lever being formed with an engageable hole such that the pin is inserted into the engageable hole when the second connector is fitted into the first connector; wherein by rotating the lever in an operational direction of the lever, the second connector is pulled towards the first connector through the pin upon displacement of the engageable hole so as to be fitted into the first connector; wherein the engageable hole is shaped such that the lever is automatically raised in the operational direction of the lever at a position where the pin is inserted into an inlet of the engageable hole.

More specifically, the inlet of the engageable hole opens in a horizontal direction for inserting the pin into the engageable hole and the engageable hole has upper and lower guide faces extending continuously from the inlet and curved upwardly, wherein curvatures of the upper and lower guide faces are set such that the lever is automatically rotated about a fulcrum through a predetermined angle in the operational direction of the lever when the pin inserted into the engageable hole from the inlet is brought into contact with the upper and lower guide faces.

The engageable hole of the lever is shaped as described above. Therefore, when the second connector is merely depressed into the first connector so as to insert the pin into the engageable hole, the lever is rotated through a predetermined angle of, for example, 10° in the operational direction of the lever. As a result, temporary stop of the lever by the stopper through engagement therebetween is cancelled such that the lever rises automatically. Accordingly, subsequent rotation of the lever can be performed easily.

Meanwhile, in order to accomplish the second object of the present invention, a lever type connector according to the present invention comprises: a first connector; a second connector which is fitted into the first connector; a lever which is rotatably mounted on the first connector; a pin which projects from the second connector; the lever being formed with a recess such that the pin is inserted into the recess when the second connector is fitted into the first connector; and a stepped portion which is provided on an outer face of the first connector and is engageable with a portion of the lever so as to temporarily stop the lever; wherein the lever held in engagement with the stepped portion is disengaged from the stepped portion upon insertion of the pin into the recess such that temporary stop of the lever is cancelled automatically.

As described above, temporary stop of the lever can be automatically cancelled at a stage requiring no operational force of the lever, in which the second connector is slightly fitted into the first connector. Therefore, the lever is released from temporary stop without the need for applying an operational force thereto and thus, can be rotated easily, thereby resulting in excellent operational efficiency of the lever.

Furthermore, in order to accomplish the third object of the present invention, a lever type connector according to the present invention comprises: a first connector; a second connector which is fitted into the first connector; a lever which is rotatably mounted on the first connector and is formed with an engageable hole; a pin which projects from the second connector and is inserted into the engageable hole so as to pull the second connector towards the first connector such that the second connector is fitted into the first connector; and a lever locking member for locking the lever at a fitting position where the second connector has been fitted into the first connector; the lever locking member including a bore, a slit surrounding a portion of the bore, a movable piece interposed between the bore and the slit and a boss engageable with the bore; the bore, the slit and the movable piece being formed on the lever, while the boss is provided at a portion of a side face of the second connector, which portion confronts the bore at the fitting position; wherein the boss is brought into and out of engagement with the bore through deflection of the movable piece.

It is preferable that the boss has a V-shaped cross section defined in an operational direction of the lever by first and second oblique faces. Meanwhile, the bore of the lever is formed by, for example, a rectangular or circular through-hole. The slit surrounds three sides of the rectangular through-hole or a half of the circular through-hole so as to be spaced a predetermined distance from the bore such that the readily deflectable movable piece is formed between the slit and the bore.

The slit and the movable piece are provided around the bore as described above. Therefore, the slit is disposed adjacent to an outer peripheral edge of the lever and the readily deflectable movable piece is disposed inside the slit. Accordingly, when the lever is locked, the boss can be inserted into the bore without the need for applying a large operational force to the lever.

Meanwhile, when the lever is unlocked, the movable piece is deflected along the V-shaped boss and a narrow peripheral edge of the lever is displaced along the V-shaped boss after the slit has passed through the boss. As a result, the lever can be unlocked easily.

BRIEF DESCRIPTION OF THE INVENTION

These objects and features of the present invention will become apparent from the following description taken in conjunction with the preferred embodiments thereof with reference to the accompanying drawings, in which.

Figure 7:
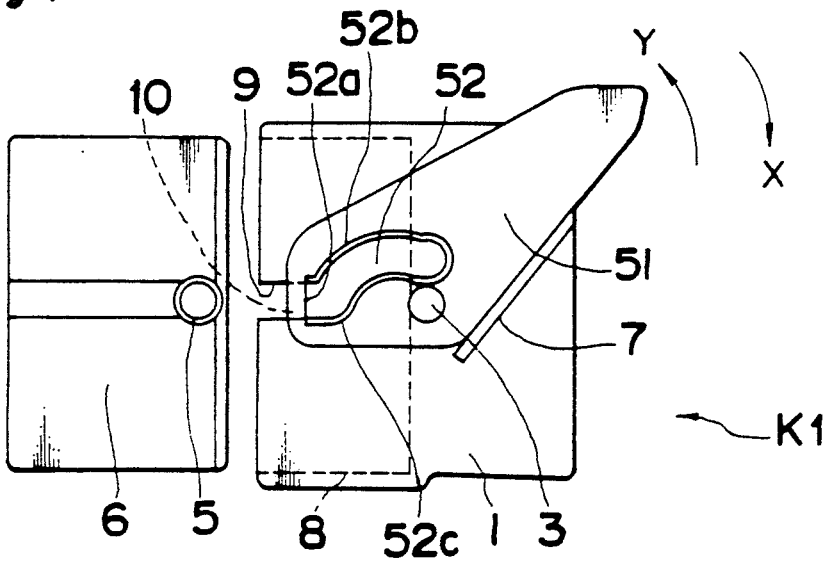
FIG. 7 is a front elevational view of first and second connectors of a lever type connector according to a first embodiment of the present invention.
Figure 10A:
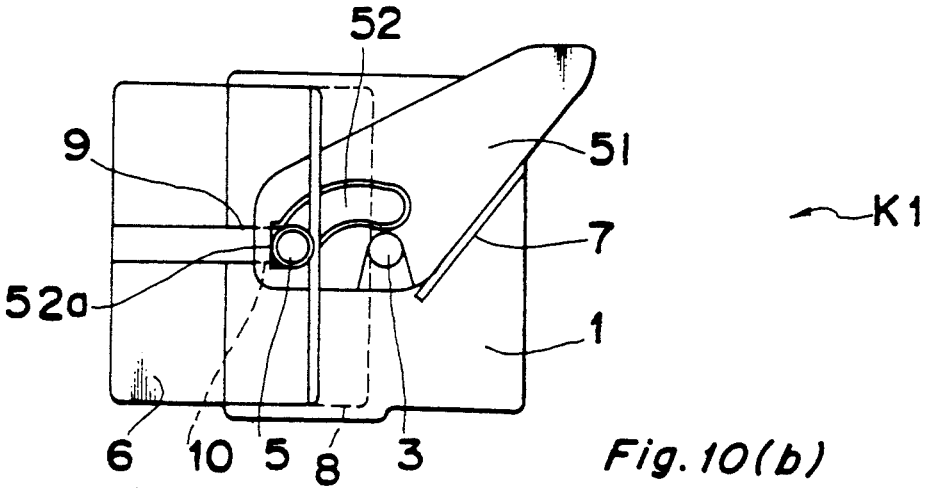
Figure 10B:
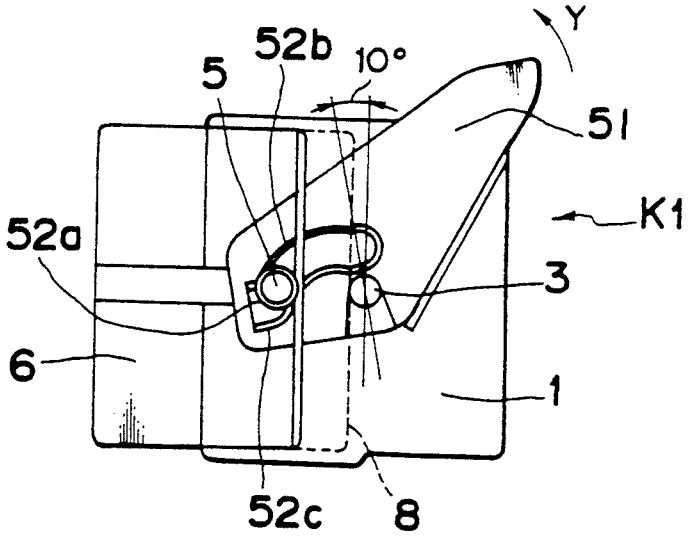
Figure 10C:
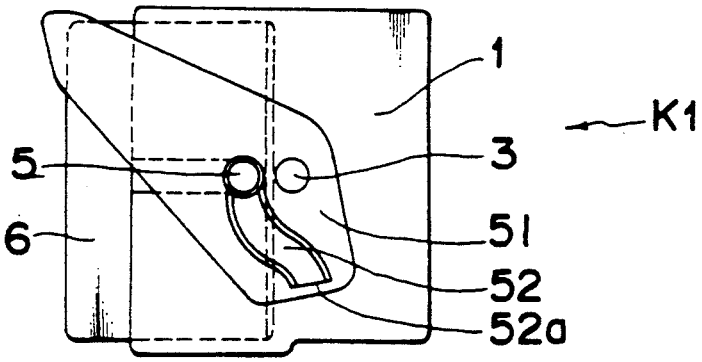
Figure 11:
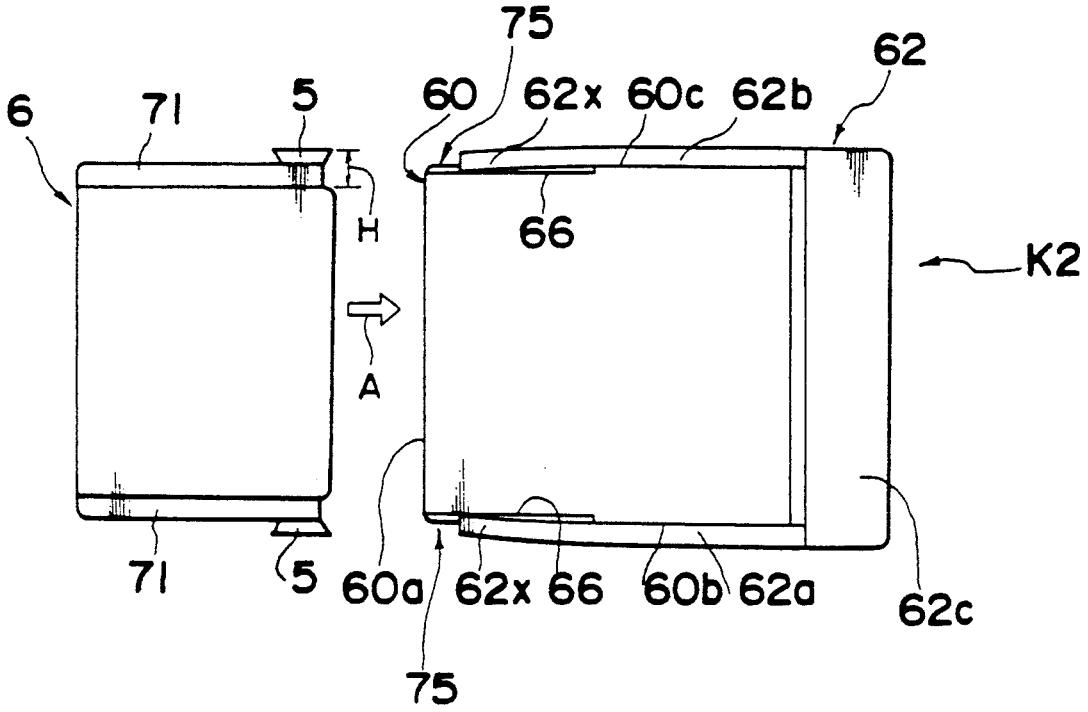
Figure 12:
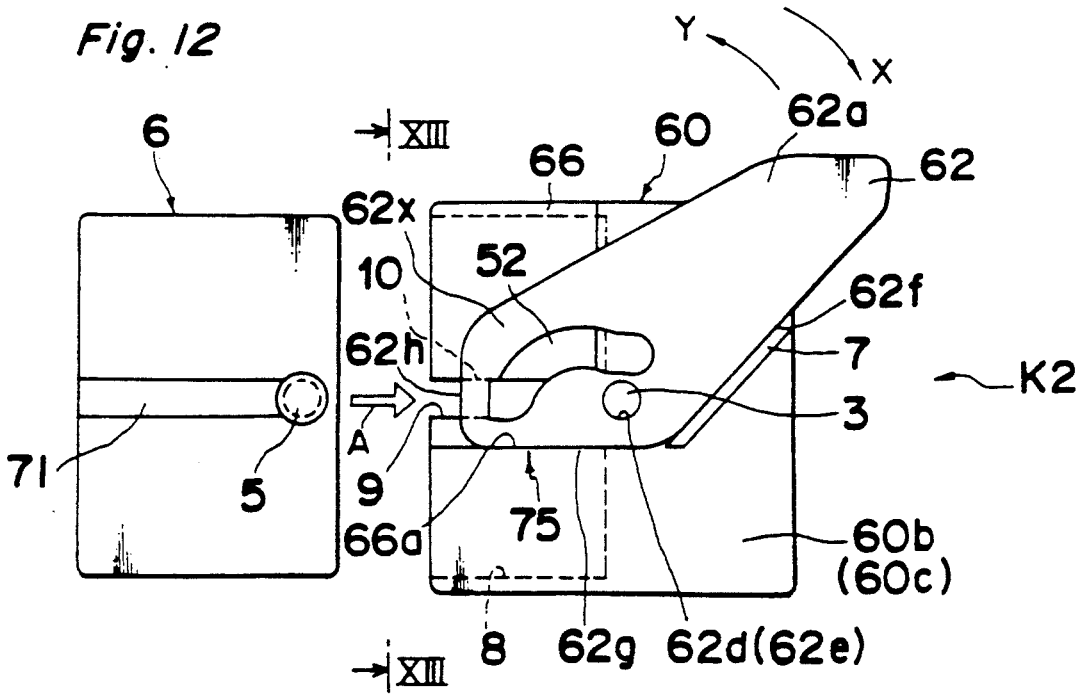
Figure 13:
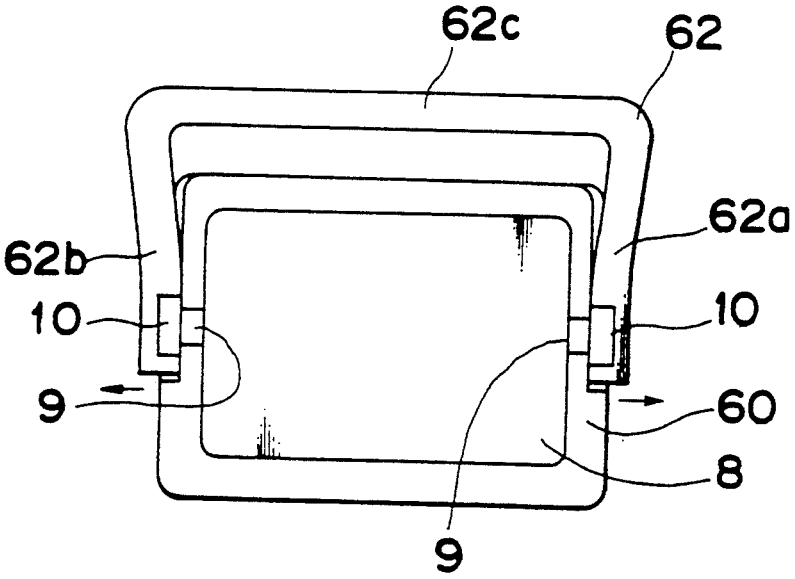
Figure 14:
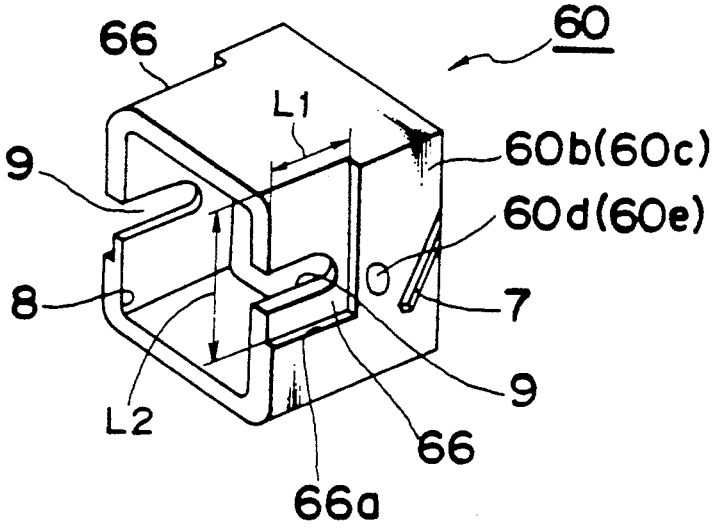
Figure 15A:
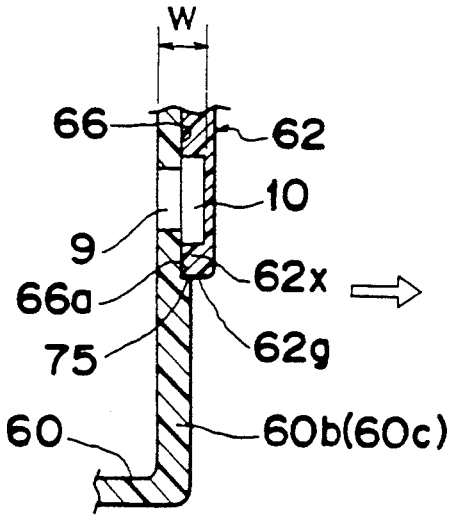
Figure 15B:
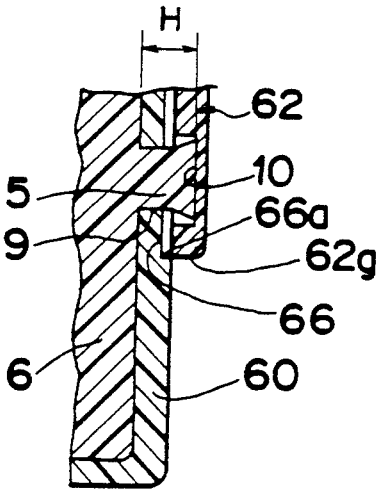
Figure 16A:
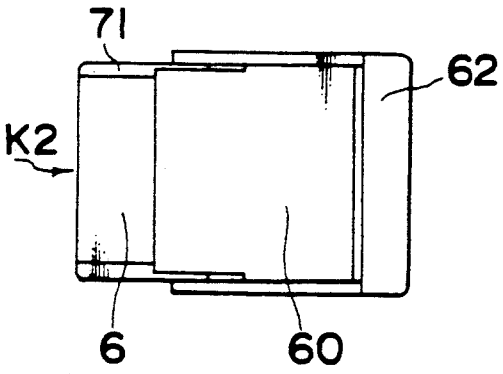
Figure 16B:
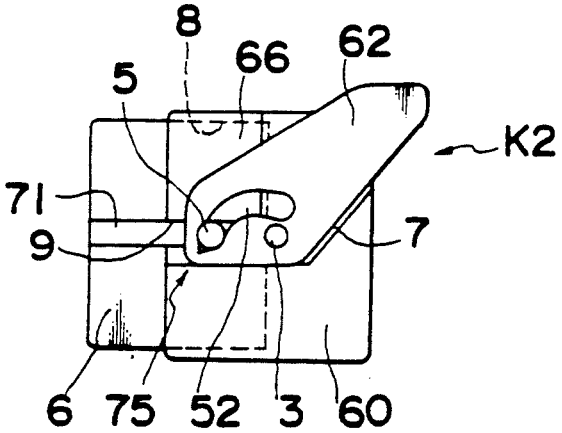
Figure 17A:
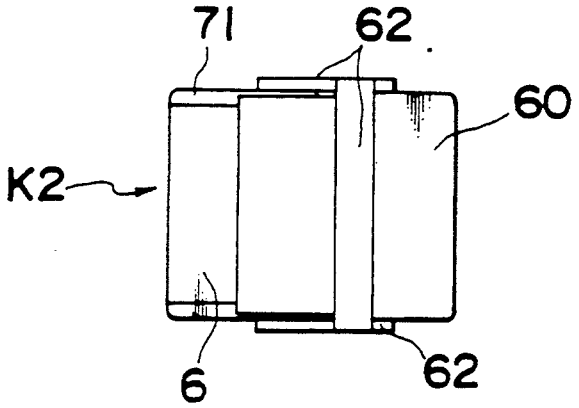
Figure 17B:
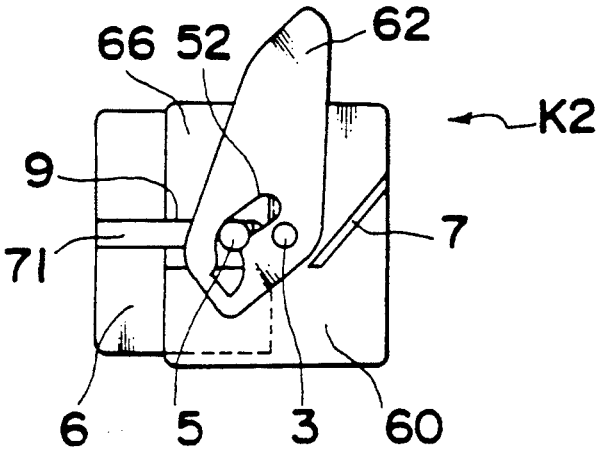
Figure 18:
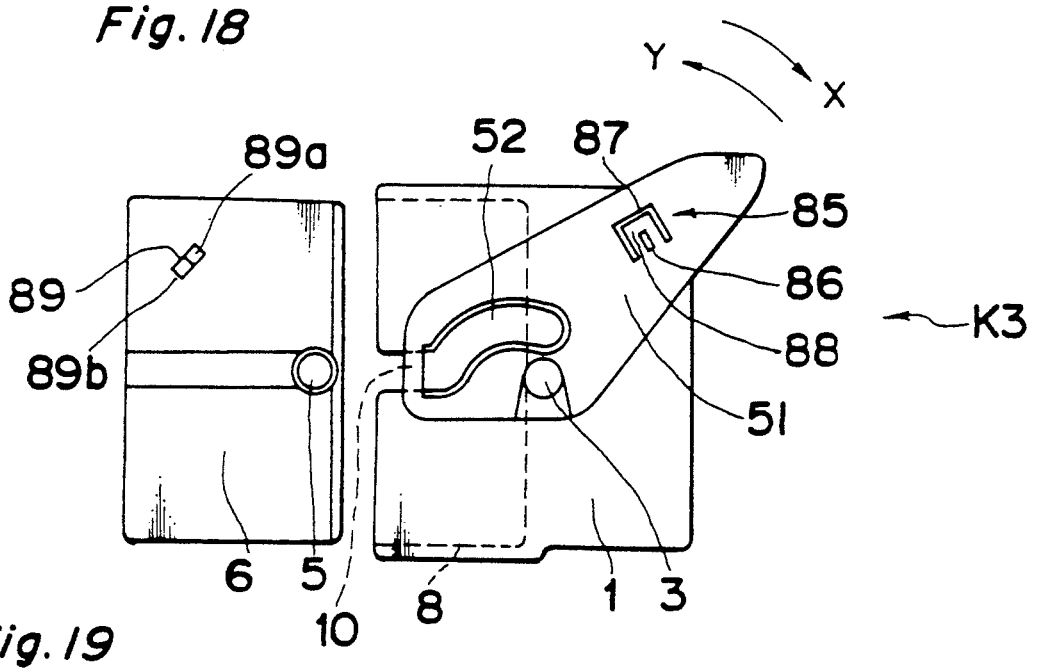
Figure 19:
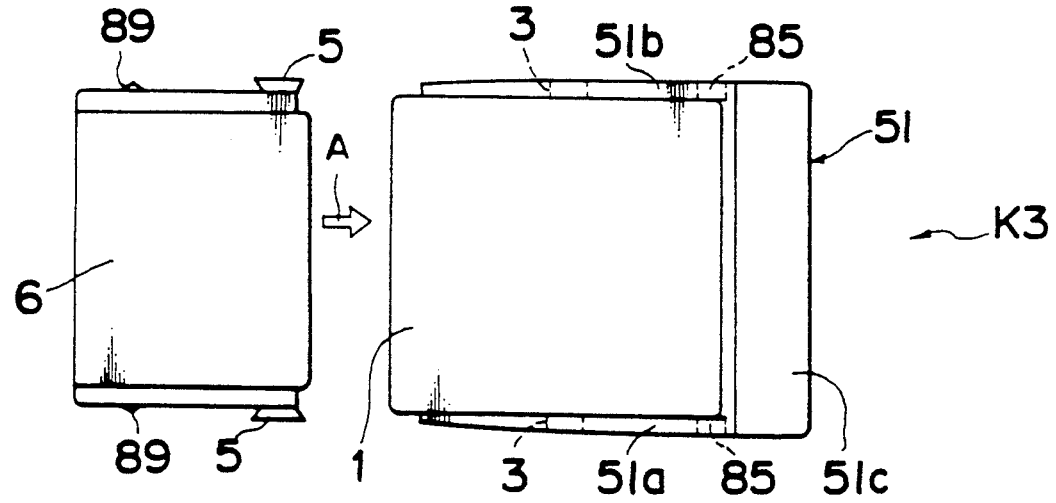
Figure 20:
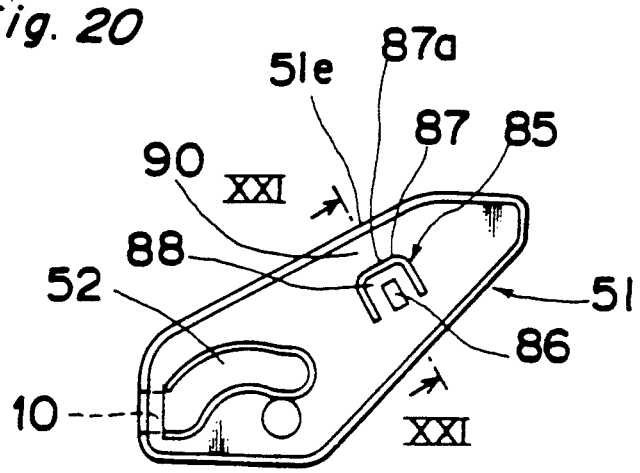
Figure 21:
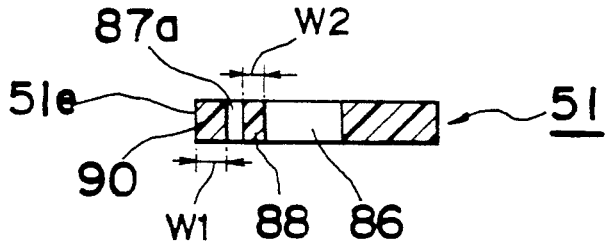
Figure 22:
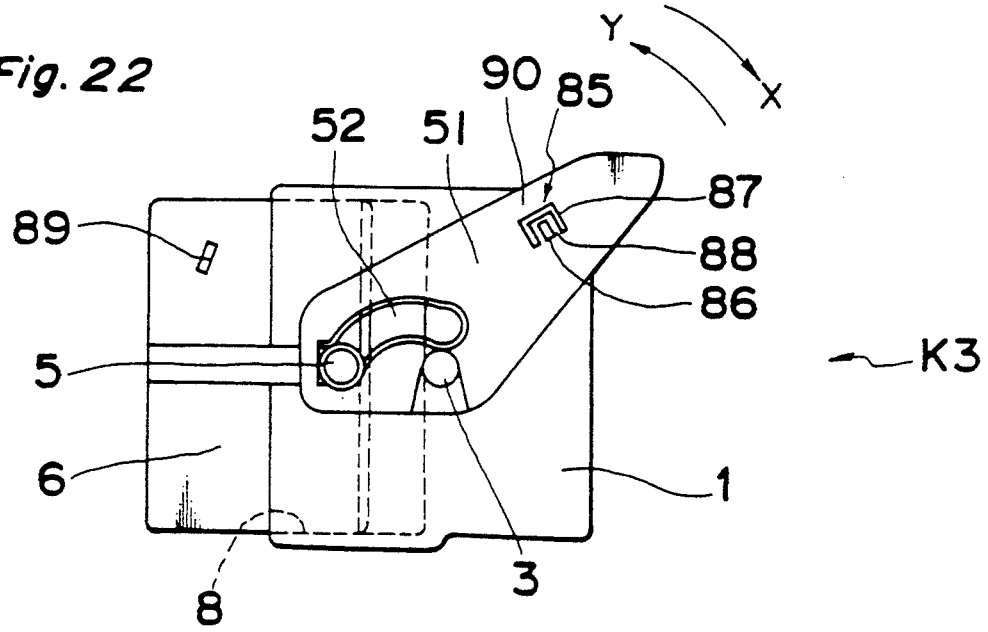
Figure 23:
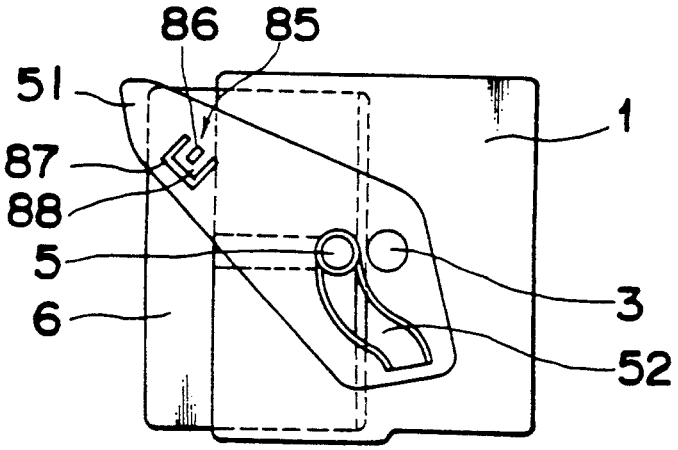
Figure 24A:
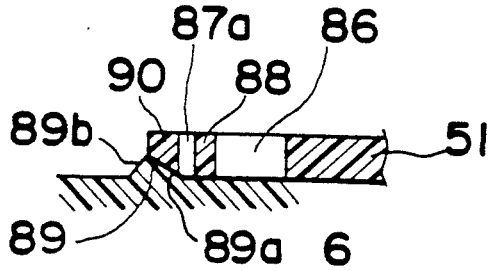
Figure 24B:
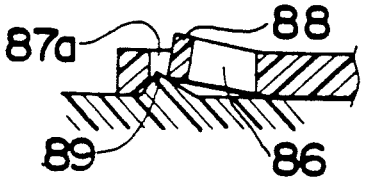
Figure 24C:
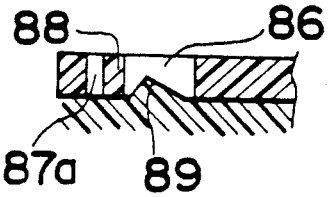
Figure 25A:
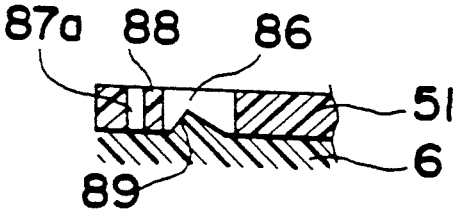
Figure 25B:
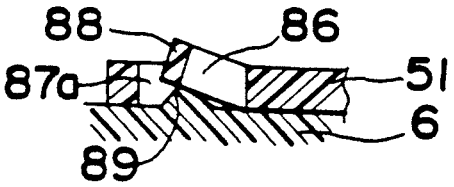
Figure 25C:
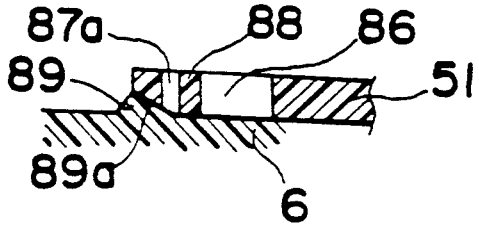
Figure 26:
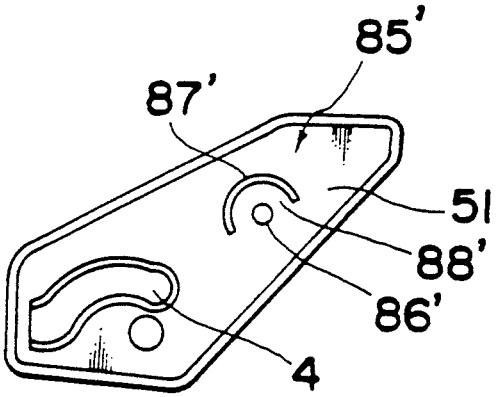

FIGS. 10(*a*) to 10(*c*) are views showing steps of fitting of the second connector into the first connector in the lever type connector of FIG. 7;

FIG. 11 is a top plan view of first and second connectors of a lever type connector according to a second embodiment of the present invention, in which a lever is set in a temporary stop state by a temporary stop member;

FIG. 12 is a front elevational view of the lever type connector of FIG. 11;

FIG. 13 is a view observed in the direction of the arrows XIII—XIII in FIG. 12;

FIG. 14 is a perspective view of the first connector of the lever type connector of FIG. 11;

FIGS. 15(*a*) and 15(*b*) are schematic sectional views showing temporary stop and cancellation of temporary stop of the lever of the lever type connector of FIG. 11, respectively;

FIGS. 16(*a*) and 16(*b*) are a top plan view and a front elevational view showing an initial stage of fitting of the second connector into the first connector in the lever type connector of FIG. 11, respectively;

FIGS. 17(*a*) and 17(*b*) are a top plan view and a front elevational view showing an intermediate stage of fitting of the second connector into the first connector in the lever type connector of FIG. 11, respectively;

FIG. 18 is a front elevational view of first and second connectors of a lever type connector including a lever locking member, according to a third embodiment of the present invention;

FIG. 19 is a top plan view of the lever type connector of FIG. 18;

FIG. 20 is an enlarged view of a lever of the ever type connector of FIG. 18;

FIG. 21 is a sectional view taken along the line XXI—XXI in FIG. 20;

FIGS. 22 and 23 are front elevational views showing an initial stage and a final stage of fitting of the second connector into the first connector in the lever type connector of FIG. 18, respectively;

FIGS. 24(*a*) to 24(*c*) are fragmentary sectional views showing steps of a locking operation of the lever locking member of FIG. 18;

FIGS. 25(*a*) to 25(*c*) are fragmentary sectional views showing steps of an unlocking operation of the lever locking member of FIG. 18; and FIG. 26 is a front elevational view showing a modification of the lever locking member of FIG. 18.

Before the description of the present invention proceeds, it is to be noted that like parts are designated by like reference numerals throughout several views of the accompanying drawings.

DETAILED DESCRIPTION OF THE INVENTION

Figure 8:
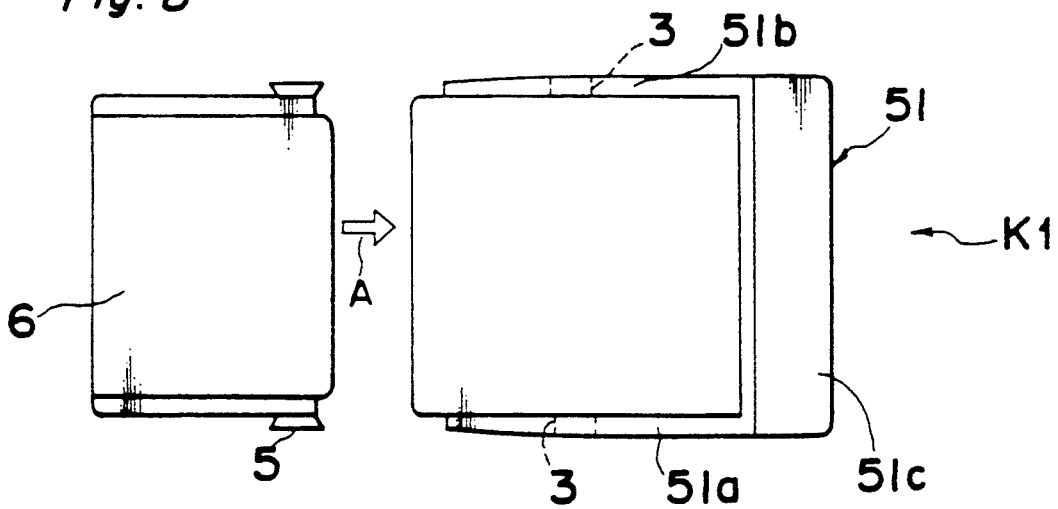
FIG. 8 is a top plan view of the lever type connector of FIG. 7.

Referring now to the drawings, there is shown in FIGS. 7 and 8, a lever type connector K1 according to a first embodiment of the present invention. The connector K1 includes a first connector 1 acting as a female connector and a second connector 6 acting as a male connector such that the second connector 6 is fitted into an opening 8 of the first connector 1 in the direction of the arrow A. The connector K1 is a multipolar connector. Thus, the first connector 1 has a chamber accommodating a number of terminals, while the second connector 6 also has a chamber accommodating a number of mating terminals to be connected to the terminals of the first connector 1, respectively. A lever 51 is rotatably mounted on opposite side faces of the first connector 1 by a pair of rods 3, while a pair of engageable holes 52 are formed on opposite sides of the lever 51, respectively. A pair of pins 5 project from opposite side faces of the second connector 6 so as to be received by the engageable holes 52, respectively when the second connector 6 is fitted into the opening 8.

A slot 9 is formed on each of opposite side walls of the first connector 1, while a recess 10 is formed on each of opposed inner side faces of the lever 51 so as to extend from a front edge of the lever 51 to a front end of the engageable hole 52. Thus, the pin 5 is inserted from the slot 9 into the engageable hole 52 through the recess 10. After the pin 5 has been inserted into the engageable hole 52 of the first connector 1, the lever 51 is rotated in the direction of the arrow Y, i.e., in the operational direction of the lever 51. As a result, the pin 5 is moved further into the engageable hole 52 through displacement of the lever 51 and thus, the second connector 6 is pulled towards the bottom of the opening 8 such that the first and second connectors 1 and 6 are coupled with each other.

As shown in FIG. 8, the the lever 51 mounted on the first connector 1 has a U-shaped construction and is formed by integral molding of synthetic resin. Thus, the lever 51 has opposite side portions 51*a* and 51*b* and a central portion 51*c* connecting the side portions 51*a* and 51*b*. The side portions 51*a* and 51*b* of the lever 51 are, respectively, disposed outside the opposite side faces of the first connector 1 such that the lever 51 is rotatably mounted on the first connector 1 by the rods 3 as described above.

Figure 9:
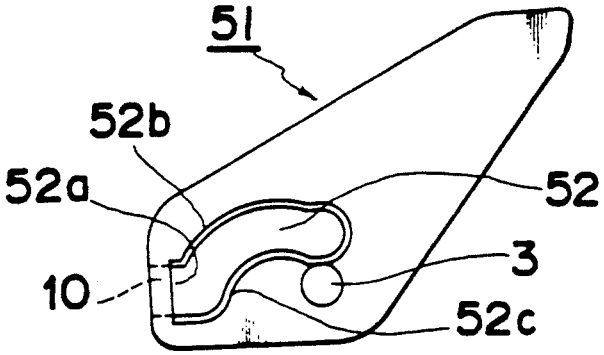
FIG. 9 is an enlarged view of a lever of the lever type connector of FIG. 7.

As shown in FIGS. 7 and 9, the engageable holes 52 pass through the side portions 51*a* and 51*b* of the lever 51, respectively and each have a generally upwardly directed arcuate shape. More specifically, the engageable hole 52 has an inlet 52*a* opening in the horizontal direction for inserting the pin 5 into the engageable hole 52 and upper and lower guide faces 52*b* and 52*c* extending continuously from the inlet 52*a* and curved upwardly at such curvatures that the lever 51 is automatically rotated about a fulcrum through a predetermined angle of, for example, 10° in the direction of the arrow Y when the pin 5 inserted into the engageable hole 52 from the inlet 52*a* is brought into contact with the upper and lower guide faces 52*b* and 52*c*.

Figure 1:
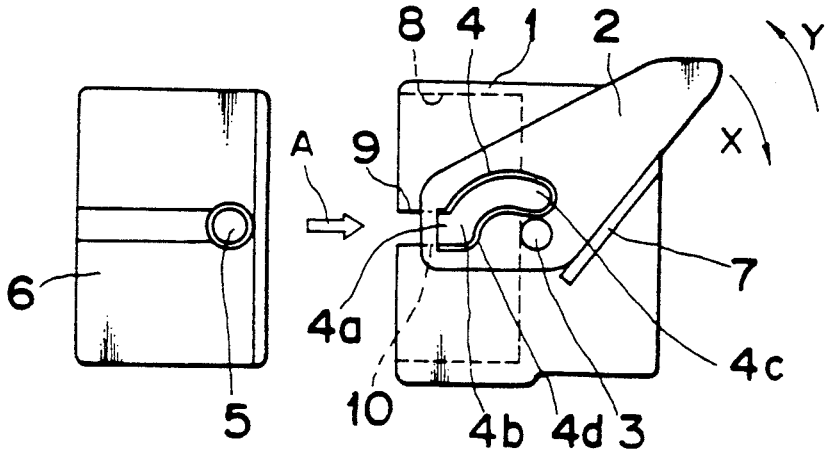
Fig. 1 PRIOR ART
FIG. 1 is a front elevational view of a prior art lever type connector (already referred to)
Figure 2:
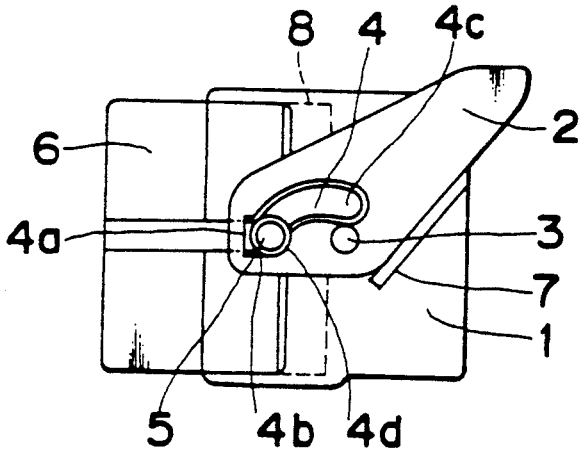
Fig. 2 PRIOR ART
FIG. 2 is a front elevational view of the prior art lever type connector of FIG. 1 (already referred to)
Figure 3:
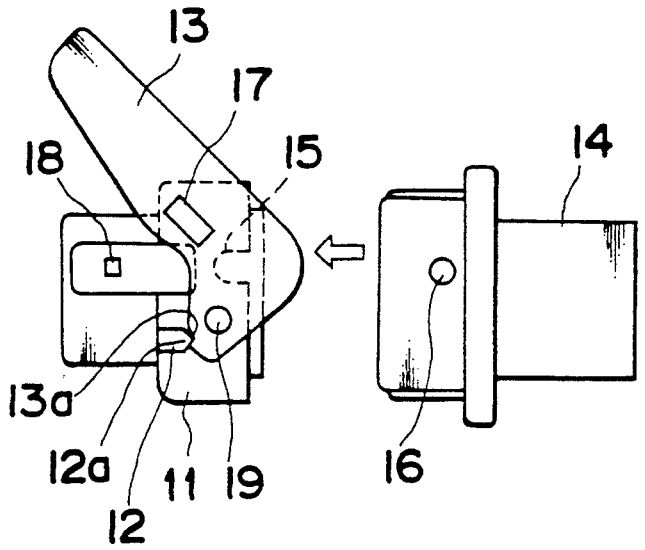
Fig. 3 PRIOR ART
FIG. 3 is a front elevational view of a further known lever type connector (already referred to)
Figure 4:
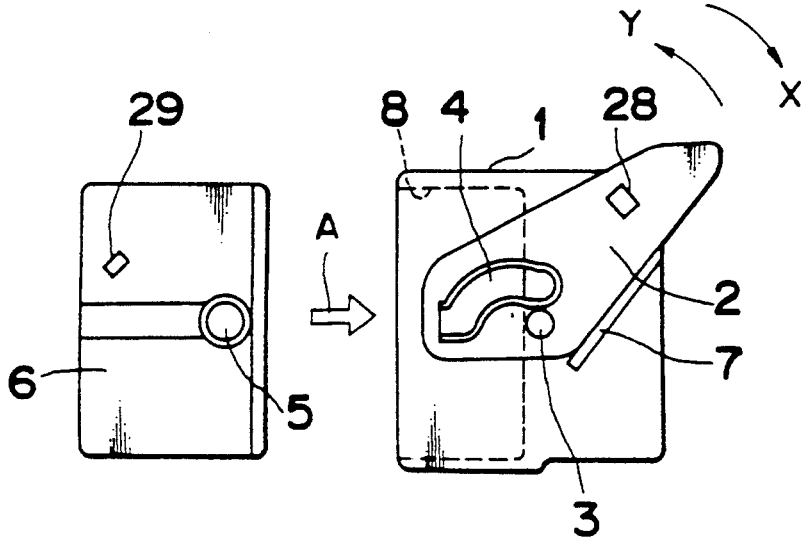
Fig. 4 PRIOR ART
FIG. 4 is a front elevational view of another conventional lever type connector (already referred to)
Figure 5:
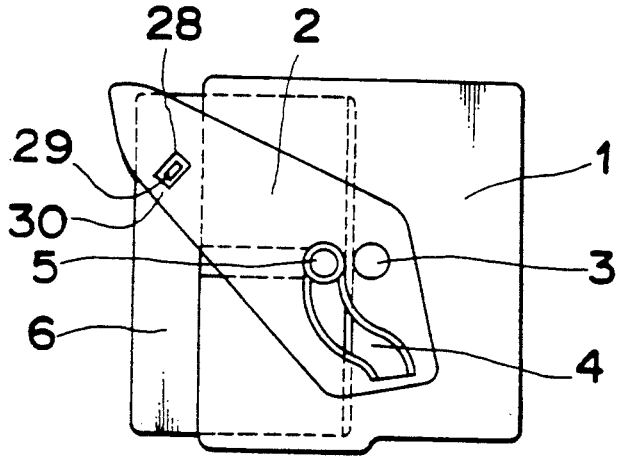
Fig.5 PRIOR ART
FIG. 5 is a front elevational view of the conventional lever type connector of FIG. 4 at its fitting position (already referred to)
Figure 6:
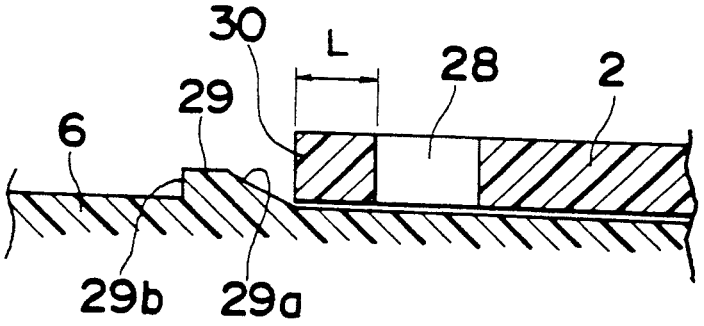
Fig.6 PRIOR ART
FIG. 6 is a view showing a lever locking member of the conventional lever type connector of FIG. 4 (already referred to)

In other words, since the engageable hole 52 does not have a horizontally oriented arcuate portion into which the pin 5 is likely to be firmly fitted as in a prior art lever type connector of FIGS. 1 and 2, the pin 5 depressed into the engageable hole 52 horizontally is immediately guided by the curved upper and lower guide faces 52*b* and 52*c* so as to forcibly rotate the lever 51 in the direction of the arrow Y.

Meanwhile, in the connector K1 of the above described arrangement, when the first connector 1 is separated from the second connector 6, rotation of the lever 51 in the direction of the arrow X is prevented by a stopper 7 projecting from each of the opposite side faces of the first connector 1, and rotation of the lever 51 in the direction of the arrow Y, i.e., in the operational direction of the lever 51, is prevented by a temporary stop member to be described later. The temporary stop member is based on a detent mechanism through engagement of an inner face of the lever 51 with a corresponding portion of an outer face of the first connector 1 so as to temporarily stop the lever 51.

When the first and second connectors 1 and 6 are coupled with each other, the second connector 6 is depressed into the opening 8 of the first connector 1 as shown in FIG. 10(*a*). The pin 5 of the second connector 6 is initially inserted into the slot 9 of the first connector 1 and then, is depressed, through the recess 10, into the inlet 52*a* of the engageable hole 52. Since the pin 5 is depressed into the engageable hole 52 horizontally and the inlet 52*a* is directed horizontally, the pin 5 can be depressed into the inlet 52*a* smoothly. As soon as the pin 5 has been depressed into the inlet 52*a*, the pin 5 is brought into contact with the arcuate upper and lower guide faces 52*b* and 52*c*. As a result, due to a depressive force of the pin 5 travelling horizontally, the lever 51 is rotated about the rods 3 through the predetermined angle of 10° in the direction of the arrow Y as shown in FIG. 10(*b*).

As described above, due to the depressive force of the pin 5, the lever 51 is automatically raised through the predetermined angle of 10° in the direction of the arrow Y. At this time, rotation of the lever 51 in the direction of the arrow Y is allowed by disengagement of the temporary stop member for temporarily stopping the lever 51. Thus, at an initial stage of fitting of the second connector 6 into the first connector 1, temporary stop of the lever 51 by the temporary stop member is cancelled such that the lever 51 is automatically raised in the direction of the arrow Y. As a result, subsequent rotation of the lever 51 in the direction of the arrow Y can be performed quite easily, thereby resulting in great improvement in operation of the lever 51.

When fitting of the second connector 6 into the first connector 1 has been completed, a lever locking member to be described later is actuated so as to lock the lever 51 in a fitting state where the second connector 6 has been fitted into the first connector 1.

As is clear from the foregoing description, the engageable hole of the lever of the lever type connector according to the first embodiment of the present invention is shaped such that at an initial stage of fitting of the second connector into the first connector, the lever is automatically raised in the operational direction of the lever through cancellation of temporary stop of the lever upon insertion of the pin into the engageable hole, thus resulting in remarkable-improvement in operational efficiency of the lever.

Meanwhile, the lever type connector according to the first embodiment of the present invention can be obtained in a simple construction by merely modifying a prior art product slightly and thus, a rise in the production cost of the lever type connector is not incurred substantially.

Referring further to FIGS. 11 and 12, there is shown a lever type connector K2 according to a second embodiment of the present invention, which includes a temporary stop member 75 for temporarily stopping a lever 62 as referred to earlier. In the same manner as in the connector K1, the connector K2 includes a first connector 60, the second connector 6 and the lever 62 mounted on the first connector 60.

As shown in FIGS. 11 and 13, the lever 62 has opposite side portions 62*a* and 62*b* and a central portion 62*c* connecting the side portions 62*a* and 62*b*. The side portions 62*a* and 62*b* of the lever 62 are, respectively, disposed outside opposite side faces 60*b* and 60*c* of the first connector 60. Apertures 62*d* and 62*e* for receiving the rods 3 are formed on the side portions 62*a* and 62*b* of the lever 62, respectively, while apertures 60*d* and 60*e* for receiving the rods 3 are formed on the side faces 60*b* and 60*c* of the first connector 60, respectively as shown in FIG. 14. Thus, one rod 3 is passed through the apertures 62*d* and 60*d*, while the other rod 3 is passed through the apertures 62*e* and 60*e* such that the lever 62 is rotatably mounted on the first connector 60 by the rod 3.

As shown in FIGS. 12 and 14, the slot 9 extends horizontally and linearly from a vertically central portion of each of opposite side walls of the first connector 60. The slots 9 of the first connector 60 are provided symmetrically and extend up to vicinity of the apertures 60*d* and 60*e*.

Furthermore, a recessed step 66 is formed on each of the side faces 60*b* and 60*c* of the first connector 60. The recessed step 66 has a lateral dimension L1 and a vertical dimension L2. The lateral dimension L1 of the recessed step 66 is substantially equal to depth of the opening 8, while the vertical dimension L2 of the recessed step 66 extends from an upper end of each of the side faces 60*b* and 60*c* to a location below the slot 9.

The stopper 7 for preventing rotation of the lever 62 in the direction of the arrow X is provided at an opposite side of the recessed step 66 with respect to the apertures 60*d* and 60*e* so as to be brought into contact with an end face 62*f* of the lever 62.

When the lever 62 is stopped by the stopper 7, an inner face of a front portion 62*x* of each of the side portions 62*a* and 62*b* of the lever 62 is bent into the recessed step 66 as shown in FIGS. 13 and 15(*a*). Therefore, a lower end face 62*g* of the lever 62 is brought into engagement with a lower edge 66*a* of the recessed step 66 such that the lever 62 is temporarily stopped. Therefore, the temporary stop member 75 is formed by the front portion 62*x* of each of the side portions 62*a* and 62*b* of the lever 62 and the recessed step 66 of each of the side faces 60*b* and 60*c* of the first connector 60.

A horizontally extending guide protrusion 71 is formed at a vertically central portion of each of the opposite side faces of the second connector 6 so as to extend from one end of the second connector 6 to the vicinity of the other end of the second connector 6. The pin 5 projects from one end of the guide protrusion 71 adjacent to the other end of the second connector 6, which confronts the opening 8 of the first connector 60. The recess 10 is obtained by recessing each of opposed inner side faces of the lever 62 from a front edge 62*h* of each of the side portions 62*a* and 62*b*.

As shown in FIGS. 15(*a*) and 15(*b*), a sum H of a height of the guide protrusion 71 and a height of the pin 5 is so set as to be larger than a sum W of a thickness of each of the side walls of the first connector 60 at the recessed step 66 and a depth of the recess 10, i.e. H > W.

In the connector K2 of the above described arrangement, when the first connector 60 and the second connector 6 are provided separately from each other prior to fitting of the second connector 6 into the opening 8 of the first connector 60, rotation of the lever 62 in the direction of the arrow Y is temporarily stopped by the temporary stop member 75 through engagement of the lower end face 62*g* of the lever 62 with the recessed step 66, while rotation of the lever 62 in the direction of the arrow X is prevented through engagement of the end face 62*f* of the lever 62 with the stopper 7 as shown in FIGS. 11 to 13 and 15(*a*).

When the first connector 60 and the second connector 6 are coupled with each other, the second connector 6 is initially fitted into the opening 8 of the first connector 60 as shown in FIGS. 16(*a*) and 16(*b*). The pin 5 of the second connector 6 is firstly inserted into the slot 9 of the first connector 60 and then, is carried into the recess 10 of the lever 62.

At this time, the sum H of the height of the guide protrusion 71 and the height of the pin 5 is so set as to be larger than the sum W of the thickness of each of the side walls of the first connector 60 at the recessed step 66 and the depth of the recess 10 as described above. Hence, when the pin 5 projecting from a front face of the guide protrusion 71 is inserted into the recess 10 of the lever 62, the pin 5 depresses the lever 62 outwardly as shown in FIG. 15(*b*) so as to push the front portion 62*x* of the lever 62 out of the recessed step 66. Therefore, engagement of the lower end face 62*g* of the lever 62 with the lower edge 66*a* of the recessed step 66 is cancelled. As a result, it becomes possible to rotate the lever 62 in the direction of the arrow Y.

By rotating the lever 62 in the direction of the arrow Y, the pin 5 is fitted into the engageable hole 52 as shown in FIG. 16(*b*). When the lever 62 is further rotated in the direction of the arrow Y, the second connector 6 is pulled towards the first connector 60 through engagement of the pin 5 with the engageable hole 52 as shown in FIG. 17(*b*) so as to be fitted into the opening 8 of the first connector 60 up to a predetermined position of the opening 8.

As will be seen from the foregoing description of the lever type connector according to the second embodiment of the present invention, the recessed step is formed on each of the opposite side faces of the second connector. When the first and second connectors are provided separately from each other prior to fitting of the second connector into the opening of the first connector, the lever is temporarily stopped by the temporary stop member through engagement of the front portion of each of the opposite side portions of the lever with the recessed step of each of the opposite side faces of the first connector. On the other hand, when the second connector is fitted into the opening of the first connector, the pin of the second connector is inserted into the engageable hole of the first connector, so that the front portion of the lever inserted into the recessed step is pushed out of the recessed step by the pin and thus, temporary stop of the lever can be cancelled automatically.

Namely, when the first and second connectors are provided separately from each other, the lever is stopped temporarily. However, when the second connector is fitted into the opening of the first connector, temporary stop of the lever is cancelled automatically such that the lever is operated for its rotation. Therefore, a large force is not required at the time of starting operation of the lever, thus resulting in improvement in operational efficiency of the lever.

Meanwhile, the lever type connector according to the second embodiment of the present invention can be obtained in a simple construction by merely modifying a prior art product slightly and thus, a rise in the production cost of the lever type connector is not incurred substantially.

FIGS. 18 and 19 show a lever type connector K3 according to the third embodiment of the present invention, which includes a lever locking member 85 as referred to earlier. In the same manner as in the connector K1, the connector K3 includes the first connector 1, the second connector 6 and the lever 51 mounted on the first connector 1.

The lever locking member 85 includes a rectangular bore 86, a substantially U-shaped slit 87 surrounding three sides of the bore 86, a substantially U-shaped flexible movable piece 88 interposed between the bore 86 and the slit 87 and a V-shaped boss 89 engageable with the bore 86. The bore 86, the slit 87 and the movable piece 88 are formed on each of the opposite sides of the lever 51, while the boss 89 is formed on each of the opposite side faces of the second connector 6. The bore 86 is formed by a through-hole and the slit 87 is spaced a predetermined distance from the three sides of the bore 86. The slit 87 and the movable piece 88 are disposed at a side deviating from the bore 86 in the direction of the arrow Y. As shown in FIGS. 20 and 21, a width W1 of a fixed portion 90 between a front side 87*a* of the slit 87 and a front edge 51*e* of the lever 51 is set to a relatively small value, while a width W2 of the movable piece 88 is also set to such a small value as to enable the movable piece 88 to be deflected easily.

Meanwhile, the boss 89 is formed at a portion of each of the opposite side faces of the second connector 6, which portion confronts the bore 86 of the lever 51 when the second connector 6 has been fitted into the opening 8 of the first connector 1. The boss 89 has first and second oblique faces 89*a* and 89*b* which are disposed at engagement and disengagement sides relative to the bore 86 of the lever 51, respectively.

In the connector K3 of the above described arrangement, the second connector 6 is depressed into the opening 8 of the first connector 1 from the state shown in FIG. 18 to the state shown in FIG. 22 in which the pin 5 is inserted into the engageable hole 52 of the lever 51. Then, from the state of FIG. 22, the lever 51 is rotated in the direction of the arrow Y and thus, the second connector 6 is pulled into the opening 8 of the first connector 1 so as to be fitted into the opening 8 of the first connector 1 as shown in FIG. 23.

Subsequently, in order to lock the lever 51 at a fitting position where the second connector 6 has been fitted into the opening 8 of the first connector 1, the lever locking member 85 is actuated by inserting the boss 89 into the bore 86 as follows. The narrow fixed portion 90 of the lever 51 is initially brought into contact with the first oblique face 89*a* of the boss 89 as shown in FIG. 24(*a*) and is displaced along the first oblique face 89*a* such that an upper end of the boss 89 is inserted into the slit 87 as shown in FIG. 24(*b*). When the lever 51 is further rotated in the direction of the arrow Y, the movable piece 88 is deflected so as to ride over the boss 89 such that the boss 89 is inserted into the bore 86 as shown in FIG. 24(*c*).

Since the readily deflectable movable piece 88 is provided by forming the slit 87 around the bore 86 as described above, the lever 51 can be easily locked at the fitting position through fitting of the boss 89 of the second connector 6 into the bore 86 of the lever 51 without the need for applying a large operational force.

In the case where locking of the lever 51 in FIG. 25(*a*) should be cancelled, the lever 51 is rotated in the direction of the arrow X. Thus, the movable piece 88 is initially deflected so as to ride over the boss 89 as shown in FIG. 25(*b*). Then, the fixed portion 90 is displaced along the second oblique face 89*b* through the slit 87. Therefore, locking of the lever 51 can be cancelled easily.

FIG. 26 shows a modification 85' of the lever locking member 85 of the connector K3. In the modified lever locking member 85', the rectangular bore 86, the U-shaped slit 87 and the movable piece 88 between the bore 86 and the slit 87 of the lever locking member 85 are replaced by a circular bore 86', a semicircular slit 87' surrounding the bore 86' and an arcuate movable piece 88' between the bore 86' and the slit 87'. Since operation of the modified lever locking member 85' is the same as that of the lever locking operation 85, description thereof is abbreviated for the sake of brevity.

As will be seen from the foregoing description of the lever type connector according to the third embodiment of the present invention, the movable piece is provided around the lever locking bore in the lever. Therefore, when the boss is inserted into the bore so as to lock the lever, the boss can be easily inserted into the bore through deflection of the movable piece without the need for applying a large operational force. Furthermore, at the time when the boss is inserted into the bore after the movable piece has ridden over the boss, the movable piece strikes the second connector hard so as to produce a click sound. As a result, an operator can have a surer feeling that the lever has been locked.

Furthermore, since the movable piece is provided around the bore and the boss has the V-shaped oblique faces, unlocking of the lever can also be performed easily.

Meanwhile, the lever type connector according to the third embodiment of the present invention can be obtained in a simple construction by merely modifying a prior art product slightly and thus, rise in production cost of the lever type connector is not incurred substantially.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A lever type connector comprising:

a first connector;

a second connector which is fitted into the first connector;

a lever which is rotatably mounted on the first connector;

a pin which projects from the second connector;

the lever being formed with a recess such that the pin is inserted into the recess when the second connector is fitted into the first connector; and a recessed step portion which is provided on an outer face of the first connector and is engageable with a bent portion of the lever so as to temporarily stop the lever;

wherein the bent portion of the lever held in engagement with the recessed step portion is disengaged from the recessed step portion upon insertion of the pin into the recess such that temporary stop of the lever is cancelled automatically.

* * * * *